US011318347B2

(12) United States Patent
Narasimhaiah

(10) Patent No.: US 11,318,347 B2
(45) Date of Patent: May 3, 2022

(54) VDN ABDOMINAL BENCH (EXERCISE APPARATUS)

(71) Applicant: Venkatagireppa Dasari Narasimhaiah, New York, NY (US)

(72) Inventor: Venkatagireppa Dasari Narasimhaiah, New York, NY (US)

(73) Assignee: Venkatagireppa D N, Karnataka (IN)

( * ) Notice: Subject to any disclaimer, the term of this patent is extended or adjusted under 35 U.S.C. 154(b) by 44 days.

(21) Appl. No.: 16/785,966

(22) Filed: Feb. 10, 2020

(65) Prior Publication Data

US 2021/0245002 A1 Aug. 12, 2021

(51) Int. Cl.
*A63B 23/02* (2006.01)
*A63B 21/055* (2006.01)
*A63B 21/068* (2006.01)

(52) U.S. Cl.
CPC ..... *A63B 23/0211* (2013.01); *A63B 21/055* (2013.01); *A63B 21/068* (2013.01)

(58) Field of Classification Search
CPC .... A63B 21/00181; A63B 21/02–0557; A63B 21/068; A63B 21/4029–4031; A63B 23/0211
See application file for complete search history.

(56) References Cited

U.S. PATENT DOCUMENTS 3,876,198 A * 4/1975 Seligman ..... A63B 23/0211 482/137
4,582,319 A * 4/1986 Luna ..... A63B 21/023 482/104
5,674,168 A * 10/1997 Wilkinson ..... A63B 22/0023 482/115
8,721,509 B1 * 5/2014 Berdut-Teruel ..... A63B 21/00069 482/121
2002/0132706 A1 * 9/2002 Sleamaker ..... A63B 21/0628 482/51
2003/0224913 A1 * 12/2003 Kuo ..... A63B 21/04 482/142
2010/0125030 A1 * 5/2010 Shifferaw ..... A63B 23/0355 482/94
2011/0275496 A1 * 11/2011 Chou ..... A63B 23/03541 482/131
2013/0337984 A1 * 12/2013 Lung ..... A63B 23/0211 482/140
2014/0274599 A1 * 9/2014 Chuang ..... A63B 21/4023 482/115
2016/0256723 A1 * 9/2016 Intlekofer ..... A63B 71/023
2017/0014681 A1 * 1/2017 Doherty ..... A63B 21/4029

* cited by examiner

*Primary Examiner* — Jennifer Robertson

(57) ABSTRACT

An exercise apparatus for performing one or more exercises is described. The exercise includes at least one support structure, one or more elastic bands, and a back support member. The one or more elastic bands is coupled to the at least one support structure at one end of the one or more elastic bands. The back support member is arranged in an inclined position such that a first end of the back support member is detachably coupled to the at least one support structure and a second end of the back support member is supported at a surface positioned at a height lower than a height at which the first end is positioned. The one or more elastic bands are configured to assist a user during one or more exercises, where the back support member configured to support a body of the user.

9 Claims, 2 Drawing Sheets

VDN ABDOMINAL BENCH (EXERCISE APPARATUS)

FIELD OF DISCLOSURE

The present disclosure relates to apparatus for performing various standard exercises and particularly to an apparatus for smooth movement of body parts without any injury and/or jerk while performing one or more exercises.

BACKGROUND OF THE INVENTION

Background description includes information that may be useful in understanding the present invention. It is not an admission that any of the information provided herein is prior art or relevant to the presently claimed invention, or that any publication specifically or implicitly referenced is prior art.

Exercising is a very essential activity for physical fitness. Exercises such as sit-ups, leg-raising are the best forms of physical fitness, and are widely recognized as a very beneficial exercise for firming up the stomach and abdominal muscles, for health and cosmetic purposes, as well as for personal satisfaction. Particularly, in the sit-up, a user lies on a supporting surface on his backside and elevates his upper body including the arms and head off the supporting surface. As the upper body pivots generally above the buttock which remains against the supporting surface, the natural tendency is for the feet to lift up, somewhat at least, off the floor. The exercise can be performed much more rapidly and more beneficially if someone, or a device of some type, holds the feet firmly in place relative to the supporting surface. This also allows for doing sit-up with weights carried by the exerciser to even further increase the force needed to lift the upper body off the supporting surface.

Exercise clubs frequently have sit-up boards for holding the feet down to assist one in doing sit-up exercises. One type sit-up board is a well-padded bar that can be located a fixed inch off the supporting board surface which allows the user to lock his feet under the supporting bar. However, with the existing sit-up boards, the user can only do around 50-60 sit-up exercises and get strained/tired although he or she wants to do more counts so as to get faster results.

Therefore, there is a need of an improved exercise apparatus that can obviate above-mentioned challenges. Additionally, it would be advantageous if the improved exercise apparatus enables the user to do one or more exercises such as leg raising exercise and the like.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

OBJECTS OF THE INVENTION

A general object of the present disclosure is to provide an improved exercise apparatus that facilitates smooth movement of body parts without any injury and jerk while performing one or more exercises.

An object of the present disclosure is to provide an improved exercise apparatus provided with back support member that is flexible to be arranged at different levels.

Another object of the present disclosure is to provide an improved exercise apparatus that is cost-effective and easy to implement.

Another object of the present disclosure is to provide an exercise apparatus that requires low maintenance cost.

These and other objects of the present invention will become readily apparent from the following detailed description taken in conjunction with the accompanying drawings.

SUMMARY OF THE INVENTION

The present disclosure relates to apparatus for performing various standard exercises and particularly to an apparatus for smooth movement of body parts without any injury and/or jerk while performing one or more exercises.

In an aspect of the present disclosure provides an exercise apparatus comprising at least one support structure; one or more elastic bands coupled to the at least one support structure at one end of the one or more elastic bands; and a back support member. The back support member is arranged in an inclined position such that a first end of the back support member is detachably coupled to the at least one support structure and a second end of the back support member is supported at a surface positioned at a height lower than a height at which the first end is positioned. The one or more elastic bands are configured to assist a user during one or more exercises, and wherein the back support member configured to support a body of the user.

In an embodiment, the exercise apparatus comprises one or more grippers coupled to other ends of the one or more elastic bands, and wherein the one or more grippers are configured to connect with one or more wearable harness connected with the user.

In an embodiment, the back support member comprises a base and a V-shaped structure coupled with the base, and wherein the V-shaped structure comprises the first member and the second member coupled with the first member each comprises a first end and a second end.

In an embodiment, the second end of the first member is connected to the second end of the second member, and wherein the first end of the second member is connected to the base.

In an embodiment, the back support member is configured with the at least one support structure through a rod on the first end of the first member.

In an embodiment, the support structure comprises at least one elongated bar, and a supporting means configured to support the at least one elongated bar in the inclined position or in the vertical position on a horizontal surface.

In an embodiment, the at least one elongated bar comprises two elongated bars, and wherein the support structure comprises one or more rollers configured between the two elongated bars.

In an embodiment, the one or more grippers is coupled to the user though one or more harness that assist in lifting a part of weight of the user.

In an embodiment, the back support member comprises one or more horizontal bars that are coupled to at least one of the first member and the second member.

In an embodiment, the one or more harness comprises a first harness configured with shoulders of the user and the second harness configured with waist of the user.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION

Figure 1:
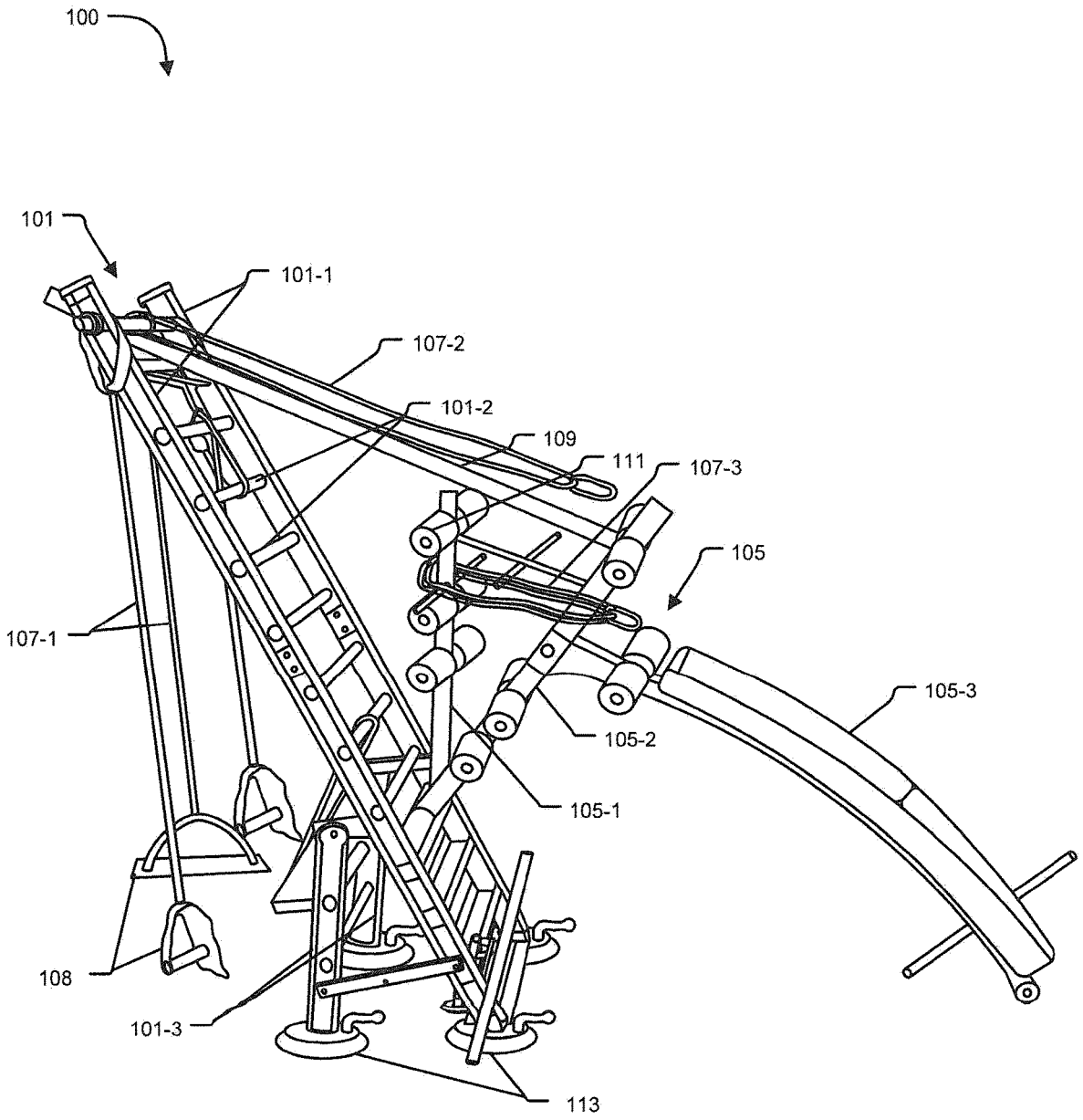
FIG. 1 illustrates an exemplary perspective view of the proposed exercise apparatus, in accordance with embodiments of the present disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

If the specification states a component or feature "may", "can", "could", or "might" be included or have a characteristic, that particular component or feature is not required to be included or have the characteristic.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims.

Exemplary embodiments will now be described more fully hereinafter with reference to the accompanying drawings, in which exemplary embodiments are shown. This disclosure may however, be embodied in many different forms and should not be construed as limited to the embodiments set forth herein. These embodiments are provided so that this disclosure will be thorough and complete and will fully convey the scope of the disclosure to those of ordinary skill in the art. Moreover, all statements herein reciting embodiments of the disclosure, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Various terms are used herein. To the extent a term used in a claim is not defined, it should be given the broadest definition persons in the pertinent art have given that term as reflected in printed publications and issued patents at the time of filing.

Embodiments explained herein relates to apparatus for performing various standard exercises and particularly to an apparatus for smooth movement of body parts without any injury and/or jerk while performing one or more exercises.

In an aspect of the present disclosure provides an exercise apparatus that may include at least one support structure; one or more elastic bands coupled to the at least one support structure at one end of the one or more elastic bands. The exercise apparatus may also include a back support member that may be arranged in an inclined position such that a first end of the back support member is detachably coupled to the at least one support structure. A second end of the back support member may be supported at a surface positioned at a height lower than a height at which the first end is positioned. The one or more elastic bands may be configured to assist a user during one or more exercises, and wherein the back support member configured to support a body of the user.

In an embodiment, the exercise apparatus may include one or more grippers coupled to other ends of the one or more elastic bands, and wherein the one or more grippers may be configured to connect with one or more wearable harness connected with the user.

In an embodiment, the back support member may include a base and a V-shaped structure coupled with the base. The V-shaped structure may include the first member and the second member coupled with the first member each comprises a first end and a second end.

In an embodiment, the second end of the first member may be connected to the second end of the second member. The first end of the second member may be connected to the base.

In an embodiment, the back support member may be configured with the at least one support structure through a rod on the first end of the first member.

In an embodiment, the support structure may include at least one elongated bar, and a supporting means configured to support the at least one elongated bar in the inclined position or in the vertical position on a horizontal surface.

In an embodiment, the at least one elongated bar may include two elongated bars, where the support structure may include one or more rollers configured between the two elongated bars.

In an embodiment, the one or more grippers may be coupled to the user though one or more harness that assist in lifting a part of weight of the user.

In an embodiment, the back support member may include one or more horizontal bars that are coupled to at least one of the first member and the second member.

In an embodiment, the one or more harness may include a first harness configured with shoulders of the user and the second harness configured with waist of the user.

FIG. 1 illustrates an exemplary perspective view of the proposed exercise apparatus, in accordance with embodiments of the present disclosure. As shown in FIG. 1, the proposed exercise apparatus 100 (hereafter referred to as apparatus 100) may include at least one support structure 101, one or more elastic bands 107 (interchangeably referred as elastic bands 107 or elastic band 107) coupled to the at least one support structure 101 at one end of the elastic bands 107. The apparatus 100 may be adapted for different body exercises, because it can be quickly and easily assembled to different positions.

In an embodiment, the at least one support structure 101 (interchangeably referred as support structures 101 or support structure 101) may include at least one elongated bar 101-1 configured to be arranged either in a vertical position or in an inclined position. In an exemplary embodiment, the support structure 101 may include two elongated bars 101-1 coupled with each other in parallel configuration. The support structure 101 may also include one or more rollers 101-2 configured to be fitted with the at least one elongated bar 101-1. In case of two elongated bars 101-1, the one or more rollers 101-2 may also be configured to be arranged between the two elongated bars, as illustrated in FIG. 1, where the two elongated bars 101-1 are arranged in an inclined position.

In an embodiment, the support structure 101 may include supporting means 101-3 configured to support the at least one elongated bar 101-1 in the inclined position or in the vertical position on a horizontal surface, as shown in FIG. 1. In an exemplary embodiment, the supporting means 101-3 may have structure similar to the at least one elongated bar 101-1, such as but not limited to, two parallel members and a set of rollers configured between the parallel members. The supporting means 101-3 can be any suitable structure to support the elongated bars 101-1.

In an embodiment, the support structure 101 may include one or more stoppers 113 configured at lower end of the at least one elongated bar 101-1, as illustrated in FIG. 1. The one or more stoppers 113 may be configured with a switch to restrict slippery movement of the at least one elongated bar 101-1.

It is to be appreciated that while embodiments of the present disclosure have been explained with reference to a single support structure, it is possible to implement the inventive concept of the present disclosure with any numbers of support structures. For example, it is possible to have the concept implemented with a pair of support structure, and all such variations are well within the scope of the present disclosure without any limitations whatsoever.

In an embodiment, the one or more elastic bands 107 may be coupled to the support structure 101 at one end. In an exemplary embodiment, the one or more elastic bands 107 may be coupled to the one or more rollers 101-2 of the support structure 101. The elastic bands 107 may be configured with a user that needs to perform one or more exercises. Particularly, the elastic bands 107 may assist the user in lifting his/her own weight and enable the user to exercise effectively. In an embodiment, the exercises may be abdominal core exercises. In an exemplary embodiment, the one or more exercises includes more than 20 exercises.

In an exemplary embodiment, the one or more elastic bands may be configured with one or more body parts of the user. In an exemplary embodiment, the elastic bands 107-1 may be configured with the foot of the user. In another exemplary embodiment, the elastic bands 107-2 may be configured to the shoulders of the user. In another exemplary embodiment, the elastic bands 107-3 may be configured to the waist of the user.

In an embodiment, the apparatus 100 may include one or more grippers 108 coupled to other ends of the one or more elastic bands 107. The one or more grippers 108 may be configured to connect with one or more body parts of the user to provide grip, or to effectively attach with the user, thereby enabling the elastic bands in assisting the user in lifting of body weight. Thus, the elastic bands 107 coupled with the grippers 108 may allow smooth movement of the body parts of the user without any jerk. In an exemplary embodiment, the one or more elastic bands 107 may be elastic rope.

In an embodiment, the apparatus 100 may include a back support member 105 coupled with the support structure 101. The back support member may be arranged in an inclined position or in a horizontal position. It would be appreciated by a person in ordinary skilled in the art that the back support member 105 may be arranged in any position depending upon a type of the exercise.

In an embodiment, the back support member 105 may include a first end and a second end. In an embodiment, the back support member 105 may be arranged with the support structure 101 such that the first end of the back support member 105 is detachably coupled to the support structure 101. In another embodiment, the second end of the back support member 105 may be supported at a surface positioned at a height lower than or equal to a height at which the first end is positioned. In an exemplary embodiment, the second end of the back support member 105 may be supported at the horizontal surface where the support structure is positioned.

In an embodiment, the back support member 105 may include a base 105-3 and a V-shaped structure coupled with the base 105-3. The V-shaped structure may include a first member 105-1 and a second member 105-2 coupled with the first member 105-1 each comprises a first end and a second end. The second end of the first member 105-1 may be connected to the second end of the second member 105-2. In another embodiment, the base 105-3 may be connected to the first end of the second member 105-2. Alternatively, the base 105-3 may be connected to the second member 105-2 anywhere between the first end and the second end of the second member 105-2. In an embodiment, a lower end of the V-shaped structure, at which both the second end of the both the first member 105-1 and the second member 105-2 meets, may be arranged at different height levels on the one or more rollers 101-2, where each of the one or more rollers 101-2 may be associated with a distinct height level. Thus, the arrangement of the lower end of the V-shaped structure at one of the one or more rollers may facilitate exercising at different height levels.

In an embodiment, the back support member 105 may include one or more horizontal bars 111 that may be coupled to at least one of the first member 105-1 and the second member 105-2. In another embodiment, the first end of the first member 105-1 may also be connected to the first end of the second member 105-2 through a connector such as but not limited to iron rod. In an exemplary embodiment, the horizontal bars 111 may be coupled anywhere on the connector. The configuration of the one or more horizontal bars 111 may allow the user to lock one or more body parts in corresponding exercises.

In an embodiment, the back support member 105 may be connected to the support structure 101. Particularly, the second end of the second member 105-2 may be connected to the support structure 101 through a rod 109. On the support structure 101, the rod 109 may be connected either to the at least one elongated bar 101-1 or to the one or more rollers 101-2.

In an embodiment, the back support member 105 and/or the support structure 101 may be configured as foldable, therefore the apparatus may be portable.

Figure 2:
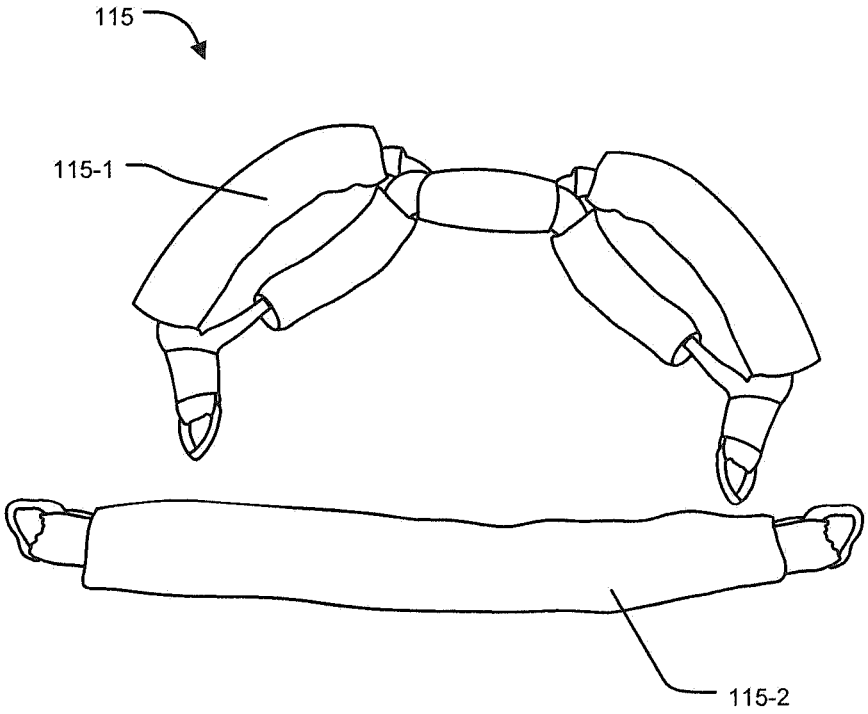
FIG. 2 illustrates an exemplary perspective view of harness of the proposed exercise apparatus, in accordance with embodiments of the present disclosure.

FIG. 2 illustrates an exemplary perspective view of harness of the proposed exercise apparatus, in accordance with embodiments of the present disclosure.

As shown in FIG. 2, the apparatus 100 may include one or more harness 115 configured to be coupled with the one or more grippers 108. The one or more harness 115 may be attached to body parts of the user such that the one or more harness 115 coupled with the one or grippers 108 assist in lifting a part of body weight of the user while doing one or more exercises such as sit-ups and leg raising exercise. In an exemplary embodiment, the harness 115 may be attached to the shoulder and/or the chest to assist in weight lifting while doing sit-up. In an exemplary embodiment, the one or more harness 115 may include a first harness 115-1 configured with shoulders of the user and the second harness 115-2 configured with waist of the user.

Therefore, the exercise apparatus with the elastic bands and harness assists the user in lifting weight of the body of the user, thereby facilitating smooth movement of body parts without any injury and jerk while performing one or more exercise. In addition, the back support member configured to be arranged at different height levels enables the user to perform one or more exercises at required height levels.

As used herein, and unless the context dictates otherwise, the term "coupled to" is intended to include both direct coupling (in which two elements that are coupled to each other or in contact each other) and indirect coupling (in which at least one additional element is located between the two elements). Therefore, the terms "coupled to" and "coupled with" are used synonymously. Within the context of this document terms "coupled to" and "coupled with" are also used euphemistically to mean "communicatively coupled with" over a network, where two or more devices are able to exchange data with each other over the network, possibly via one or more intermediary device.

Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

While some embodiments of the present disclosure have been illustrated and described, those are completely exemplary in nature. The disclosure is not limited to the embodiments as elaborated herein only and it would be apparent to those skilled in the art that numerous modifications besides those already described are possible without departing from the inventive concepts herein. All such modifications, changes, variations, substitutions, and equivalents are completely within the scope of the present disclosure. The inventive subject matter, therefore, is not to be restricted except in the spirit of the appended claims.

It should be apparent to those skilled in the art that many more modifications besides those already described are possible without departing from the inventive concepts herein. The inventive subject matter, therefore, is not to be restricted except in the spirit of the appended claims. The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

In the description of the present specification, reference to the term "one embodiment," "an embodiments", "an example", "an instance", or "some examples" and the description is meant in connection with the embodiment or example described The particular feature, structure, material, or characteristic included in the present invention, at least one embodiment or example. In the present specification, the term of the above schematic representation is not necessarily for the same embodiment or example. Furthermore, the particular features structures, materials, or characteristics described in any one or more embodiments or examples in proper manner. Moreover, those skilled in the art can be described in the specification of different embodiments or examples are joined and combinations thereof.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

Advantages of the Invention

The present disclosure provides an improved exercise apparatus that facilitating smooth movement of body parts without any injury and/or jerk while performing one or more exercise.

The present disclosure provides an improved exercise apparatus provided with back support member that is flexible to be arranged at different levels.

The present disclosure provides an improved exercise apparatus that is cost-effective and easy to implement.

The present disclosure provides an exercise apparatus that requires low maintenance cost.

I claim:

1. An exercise apparatus comprising:

at least one support structure;

one or more elastic bands coupled to the at least one support structure at one end of the one or more elastic bands; and a back support member, the back support member being arranged in an inclined position such that a first end of the back support member is supported at a surface positioned at a height lower than a height at which the first end is positioned, wherein the back support member comprises a base and a V-shaped structure coupled with the base;

wherein the V-shaped structure comprises a first member and a second member coupled with the first member, wherein the first member and the second member each comprises a first end and a second end;

wherein the second end of the first member is connected to the second end of the second member at a lower end of the V-shaped structure, and the lower end is attachable to the support structure in a plurality of positions at different height levels; and wherein the one or more elastic bands are configured to attach to one or more body parts of a user to assist the user during one or more exercises, and wherein the back support member is configured to support a body of the user.

2. The exercise apparatus as claimed in claim 1, wherein the exercise apparatus comprises one or more grippers coupled to other ends of the one or more elastic bands, and wherein the one or more grippers are connected with one or more wearable harnesses configured to be connected with the user during the one or more exercises.

3. The exercise apparatus as claimed in claim 2, wherein the one or more grippers are configured to be coupled to the user though the one or more harnesses.

4. The exercise apparatus as claimed in claim 3, wherein the one or more harnesses comprises a first harness configured to connect with shoulders of the user and a second harness configured to connect with a waist of the user.

5. The exercise apparatus as claimed in claim 1, wherein the back support member is configured with the at least one support structure through a connecting rod on the first end of the first member.

6. The exercise apparatus as claimed in claim 1, wherein the support structure comprises at least one elongated bar, and a supporting means configured to support the at least one elongated bar in an inclined position or in a vertical position on a horizontal surface.

7. The exercise apparatus as claimed in claim 6, wherein the at least one elongated bar comprises two elongated bars, and wherein the support structure comprises one or more rollers configured between the two elongated bars.

8. The exercise apparatus as claimed in claim 7, wherein the one or more elastic bands are coupled to the one or more rollers of the support structure.

9. The exercise apparatus as claimed in claim 1, wherein the back support member comprises one or more horizontal bars coupled to at least one of the first member and the second member.

* * * * *